United States Patent [19]

Schmidt

[11] 4,219,974

[45] Sep. 2, 1980

[54] COPY-GRINDING APPARATUS

[75] Inventor: Erich Schmidt, Wien, Austria

[73] Assignee: Maschinenfabrik Zuckermann Komm. Ges., Vienna, Austria

[21] Appl. No.: 905,287

[22] Filed: May 11, 1978

[30] Foreign Application Priority Data

May 11, 1977 [DE] Fed. Rep. of Germany ..... 2721244

[51] Int. Cl.[2] ..... B24B 5/16; B24B 21/16

[52] U.S. Cl. ..... 51/101 R; 51/145 R; 51/147; 51/397; 51/399; 144/134 F; 144/144 R

[58] Field of Search ..... 51/101 R, 135 R, 145 R, 51/147, 395, 397, 399, 49, 50 PC; 144/134 E, 134 F, 144 R

[56] References Cited

U.S. PATENT DOCUMENTS

| | | | |
|---|---|---|---|
| 1,179,999 | 4/1916 | Blevney | 51/135 R |
| 2,115,908 | 5/1938 | Fox | 51/49 |
| 2,641,089 | 6/1953 | Fouquet | 51/101 R |
| 2,724,934 | 11/1955 | Urquhart | 51/147 |
| 2,754,637 | 7/1956 | Schiavone | 51/101 R |
| 2,896,378 | 7/1959 | Keating | 51/145 R |
| 3,053,020 | 8/1962 | Bratton | 51/399 |
| 3,164,144 | 1/1965 | Adams, Jr. | 51/101 R |
| 3,925,937 | 12/1975 | Stevens et al. | 51/145 R |
| 4,031,669 | 6/1977 | Koide et al. | 51/145 R |
| 4,051,636 | 10/1977 | Heine | 51/145 R |

FOREIGN PATENT DOCUMENTS

| | | |
|---|---|---|
| 879374 | 7/1953 | Fed. Rep. of Germany . |
| 940817 | 3/1956 | Fed. Rep. of Germany . |
| 338738 | 7/1959 | Switzerland . |

*Primary Examiner*—Harold D. Whitehead
*Assistant Examiner*—K. Bradford Adolphson
*Attorney, Agent, or Firm*—Finnegan, Henderson, Farabow, Garrett & Dunner

[57] ABSTRACT

This invention relates to apparatus for copy-grinding workpieces consisting particularly of wood or a similarly grindable material, e.g. aluminum, and having an uneven surface, such apparatus comprising a rotatable clamping device for receiving a workpiece therein and at least one driven grinding tool positively controlled by a scanning roller scanning a master model and adapted to be advanced along the workpiece in the direction of the axis of rotation by an advancing mechanism.

11 Claims, 10 Drawing Figures

COPY-GRINDING APPARATUS

BACKGROUND OF THE INVENTION

Known from West German Auslegeschrift No. 1 043 161 issued Nov. 6, 1958 to Rolf Geiger is an apparatus of the above defined type, wherein the grinding tool is constructed as a belt grinding unit revolving in a plane extending normally with respect to the axis of rotation of the clamping device.

Apparatus of this type is well suited for working round or substantially convex workpieces. In many cases, it is also possible to satisfactorily grind flat workpieces or workpieces having slightly uneven surface areas. Problems are encountered, however, in the case of workpieces having wave-shaped surface areas. Particularly in the case of wave-forms extending transversely with respect to the axis of rotation, there exists the grave danger that the grinding tool cuts into the contoured surface portions with its lateral edges, so that a smoothly ground surface is not obtained. A typical example for such problem-ridden workpieces are shoe soles, specifically the orthopedic soles of wooden sandals. In the case of these workpieces, having alternating valley-shaped depressions and transversely extending wave contours, even longitudinal grinding does not lead to the desired success.

It is generally known that wooden sandals or similarly shaped wooden insoles are extremely difficult to shape by copy-grinding due to the configuration of the foot support required for medical reasons. The greatest problems are encountered in the forward portions of such workpieces whereat a hill-shaped ridge has to be shaped for giving the orthopedically required support to the toes. With the known apparatus, it is not possible to shape this type of wooden sandals, since the grinding thereof results in an uneven, coarse-grained surface particularly in the area of this ridge. If these workpieces were to be shaped by longitudinal grinding, difficulties would be encountered at least at the depression provided at the heel portion.

SUMMARY OF THE INVENTION

It is an object of the invention to provide an apparatus of the above-defined type, with the aid of which it is also possible to automatically grind workpieces having surface areas that are difficult to shape.

To achieve this object, the invention provides that for shaping of workpieces having wave-shaped, concave surface areas extending substantially transversely of the axis of rotation, the grinding tool is mounted for pivotal movement about an axis extending generally normally to the axis of rotation of the workpiece so as to vary its angle of attack.

In operation of the apparatus according to the invention it was unexpectedly found that the above discussed problems were not encountered with respect to the shaping of workpieces. It is believed that the pivotal mounting of the grinding tool according to the invention permits the grinding tool to be oriented such that its lateral edges can no longer cut into the surface areas raising above the level of the surrounding surface portions. The correct angle of attack can be empirically determined once for each workpiece. It has been observed that the grinding tool merely has to be adjusted at an angle relative to a plane extending generally normal to the axis of rotation of the workpiece such that in view of the direction of rotation of the workpiece and the direction of advance of the grinding tool, the driven grinding tool will ride up on the elevations in the manner of a wheel, thus avoiding the possibility of cutting into the contoured surface portions with its lateral edges.

In order to provide a stable mounting for the grinding tool while permitting positive coupling to the scanning roller, the invention provides that the grinding tool is mounted on pivotally supported parallel arms. According to an advantageous embodiment of the invention, the grinding tool is pivotally mounted to each of the parallel arms by means of a guide bushing. Thanks to this stable mounting, it is possible to locate the drive source for the grinding tool, for instance an electric motor, closely adjacent the tool itself.

In a further embodiment the invention provides that the grinding tool is connected to the likewise pivotally mounted scanning roller through a transmission arrangement adapted to transmit the selected angle of attack of the grinding tool. Such transmission arrangement ensures simultaneous pivoting of the grinding tool and the scanning roller for varying the angle of attack.

In order to obtain point contact of the tool it is preferred that the grinding tool has a crowned grinding surface.

If a belt grinding unit is employed for the grinding tool, at least the pressure roller of the belt grinding unit should have a toroidal shape, i.e., a circumferential surface of semicircular cross section.

According to a further embodiment of the invention, a grinding belt adapted to closely conform to the crowned circumferential surface of the pressure roller is obtained by connecting a plurality of woven belt sections at their longitudinal ends, with the warp threads of the belt sections extending slightly obliquely with respect to the belt's axis.

In order to obtain the required tensional strength of the belt along its longitudinal axis, each section preferably contains at least one continuous warp thread extending from one of its connected ends to the other.

For avoiding the drawbacks caused by increased thickness of the grinding belt adjacent the connection positions, it is preferred to form segment-shaped cutouts in the grinding belt at both sides of each connection position. This results in the connection positions of the belt having an increased elasticity.

In order to obtain a reliable connection between the belt sections, the connection edges thereof should preferably extend parallel to the direction of the weft threads. This offers the advantage that the belt sections may be formed by simply cutting parallel to the weft threads, and that fraying of the belt section ends during assembly is avoided.

BRIEF DESCRIPTION OF THE DRAWINGS

An embodiment of the invention shall now be described with reference to the accompanying drawings, wherein.

The drawings show an apparatus 1 for copy-grinding workpieces 2 having an uneven surface.

DETAILED DESCRIPTION OF THE INVENTION

Figure 8:
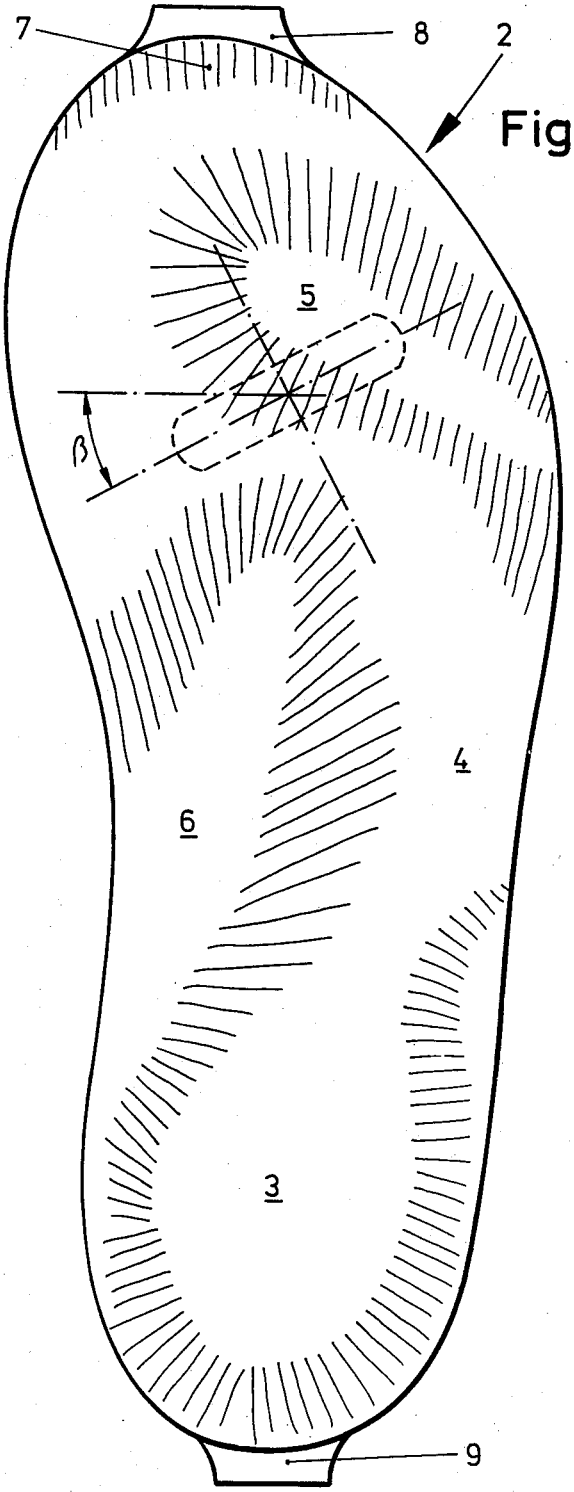
FIG. 8 shows a top plan view of a wooden sandal.
Figure 9:
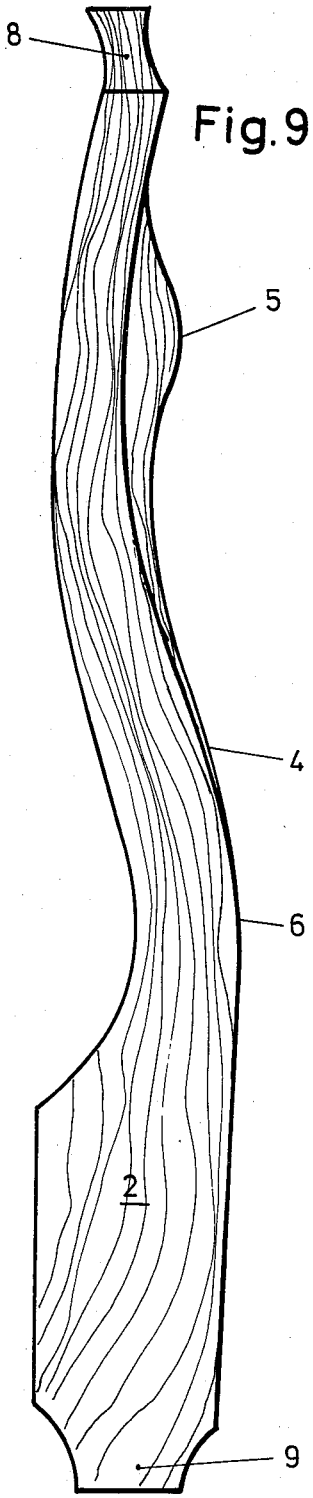
FIG. 9 shows an elevational side view of the wooden sandal shown in FIG. 8.

In the present case, the workpieces are wooden sandals such as shown in FIGS. 8 and 9. The curved contours of the sandal, particularly of the foot support bed thereof are clearly shown. At the heel portion there is provided a valley-shaped depression 3 opening towards the central portion of the foot support bed in an easy slope 4. Adjacent the toe portion, the wooden sandal has a ridge 5 of hill-shaped cross section extending generally transversely to the longitudinal axis of the sandal 2. The highest point of the foot support bed is located near the inner edge of the sandal adjacent said slope 4, as shown at 6. From this point the partially concave surface slopes downwards on all sides.

Adjacent the forward end, the edge of the shoe sole forms a further slightly ascending contour 7.

Figure 1:
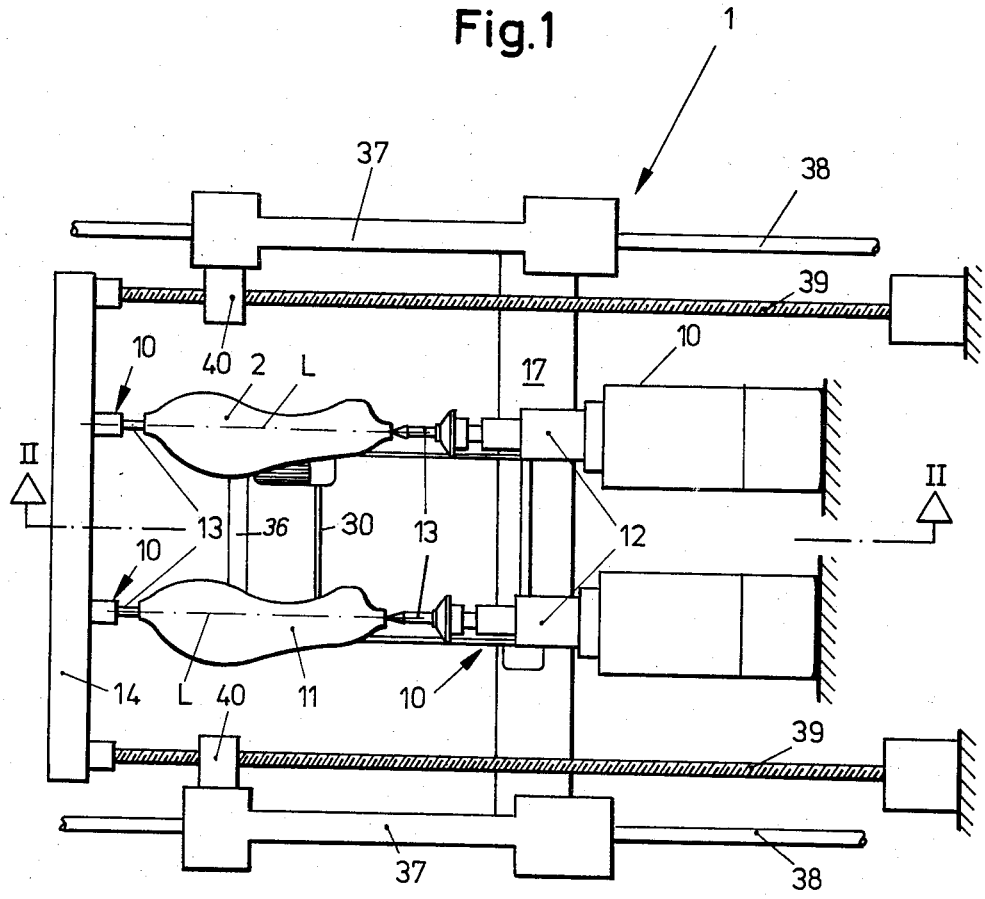
FIG. 1 shows a diagrammatic top plan view of an apparatus according to the invention.

Projections 8 and 9 at both ends of the shown workpiece are provided for clamping workpiece 2 in a clamping device 10 of conventional design. As shown in FIG. 1, the longitudinal axis of workpiece 2 coincides with an axis L about which the clamping device 10 rotates during operation. The same applies to a master model 11 clamped parallel to workpiece 2 in an identical clamping device 10. In the present case the stationary clamping devices each comprises hydraulically actuated clamping cylinders 12 for clamping the master model or workpiece, respectively, with its projections 8, 9 between a pair of opposite clamping fingers 13.

Drive means for simultaneously rotating the workpiece and the master model is enclosed in a housing 14.

Figure 2:
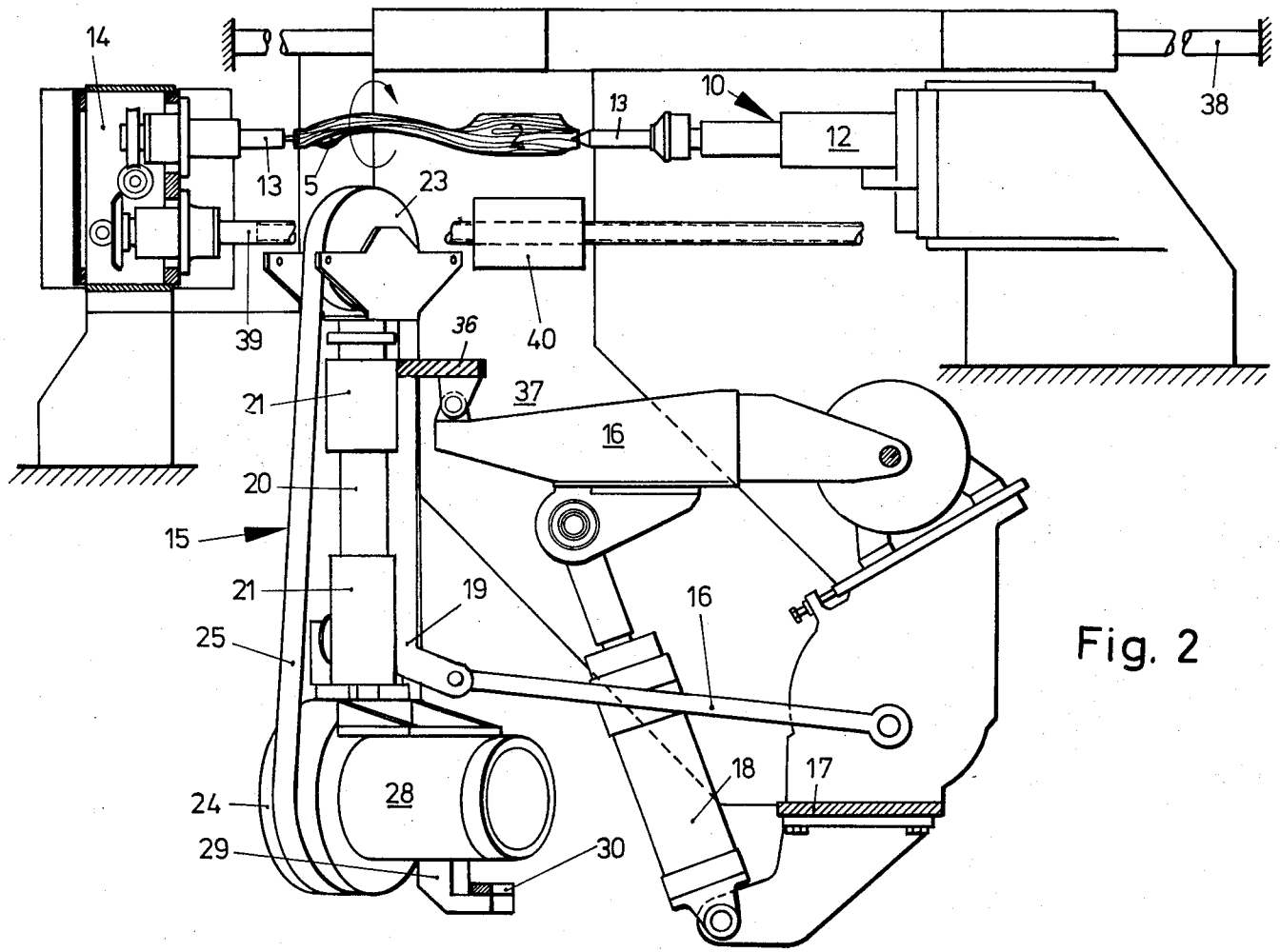
FIG. 2 shows a sectional view of the apparatus shown in FIG. 1, substantially along the line II—II.

As shown in FIG. 2, the drive means comprises a worm gear transmission having a second output shaft the purpose of which will be explained hereinafter.

Figure 3:
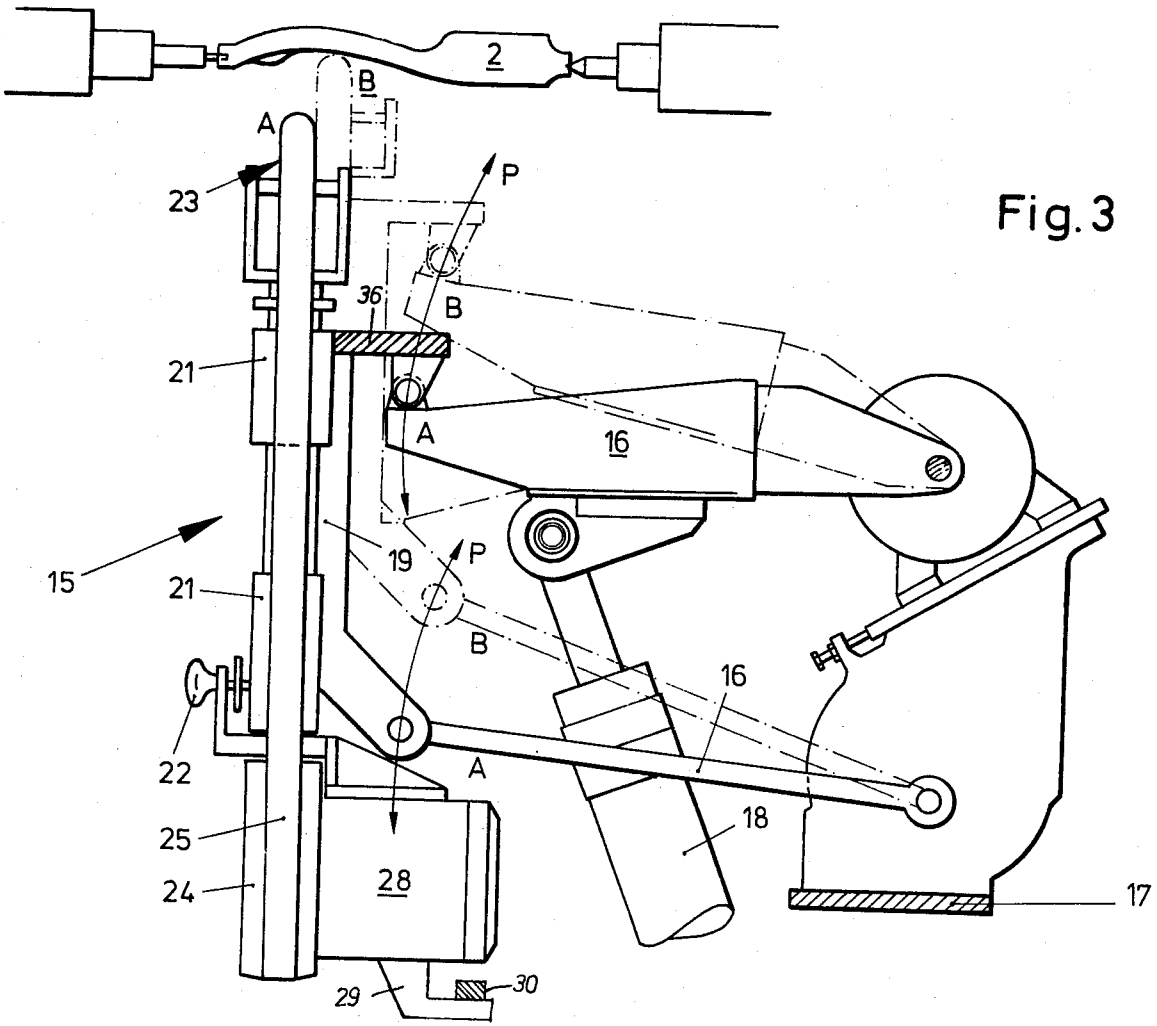
FIG. 3 shows a lateral detail view of a belt grinding unit mounted on parallel arms.

Apparatus 1 further comprises a grinding tool in the form of a belt grinding unit 15 pivotally supported by parallel arms 16. As shown in FIGS. 2 and 3, upper arm 16 is connected to a biassing cylinder 18 carried by a transverse bracket 17 and serving for advancing belt grinding unit 15 from an initial position A in the direction of arrows P towards workpiece 2 into an operative position B shown in phantom lines. The free ends of both arms 16 are connected to a support 19 comprising a pair of spaced guide bushings 21 for receiving therein a mounting shaft 20 of belt grinding unit 15. For varying the angle of attack of the belt grinding unit relative to the axis of rotation L of the clamping device, the belt grinding unit is mounted in said bushings 21 for pivotal movement about the axis of shaft 20, there being provided a clamping screw 22 for locking the grinding unit in the selected angular position. In the present case, shaft 20 is disposed generally normally with respect to the axis of rotation L, i.e. it is not inclined relative thereto.

Figure 5:
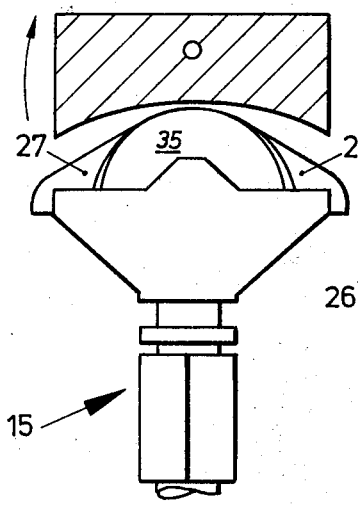
FIG. 5 shows a front view of a further embodiment of a belt grinding unit.
Figure 4:
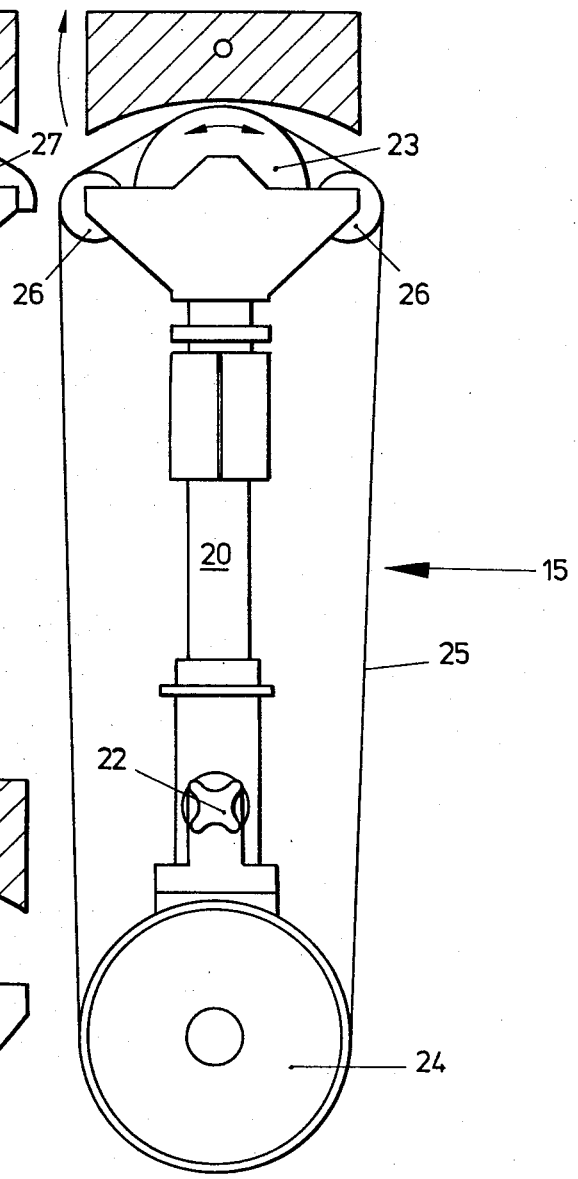
FIG. 4 shows a front view of a belt grinding unit similar to that shown in FIGS. 2 and 3.

As seen in FIG. 4, each belt grinding unit comprises a pressure roller 23 and a driving roller 24. A grinding belt of a type discussed hereinafter extends around the two rollers. Grinding belt 25 may be guided directly around pressure roller 23 or, as shown in FIG. 4, via guide means located adjacent thereto, such as guide rollers 26. Shown in FIG. 5 are guide rails 27 associated with the scanning roller in case of the employment of the guide rollers adjacent the pressure roller.

Figure 10:
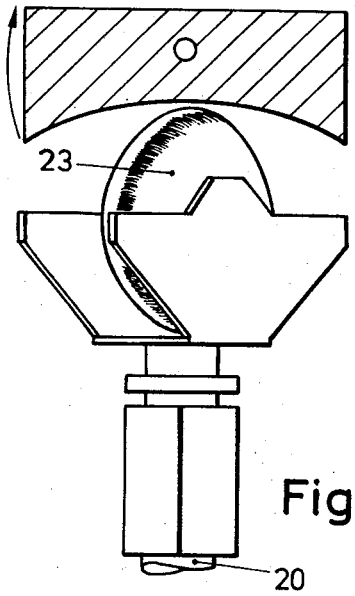
FIG. 10 shows a perspective view of a toroidal pressure roller having a crowned surface.

In all cases the pressure roller is of toroidal shape as particularly shown in FIGS. 3 and 10.

Drive roller 24 in the present case is directly coupled to a drive source 28 in the form of an electric motor, the latter being mounted on shaft 20 for pivotal movement together with the pressure and drive rollers. At its under side, motor 28 has a bracket 29 supporting a coupling rod 30 the purpose of which will be explained hereinafter.

Grinding belt 25 is composed of a plurality of woven belt sections 31 (FIG. 7) interconnected at their longitudinal ends and including warp threads 32 extending at an angle relative to the longitudinal axis B of the belt. In each belt section 31, at least one warp thread 32 extends from one connection V to an adjacent belt section to the other connection thereof, so that at least one continuous warp thread is available in each belt section for supporting axial tensional forces.

Figure 7:
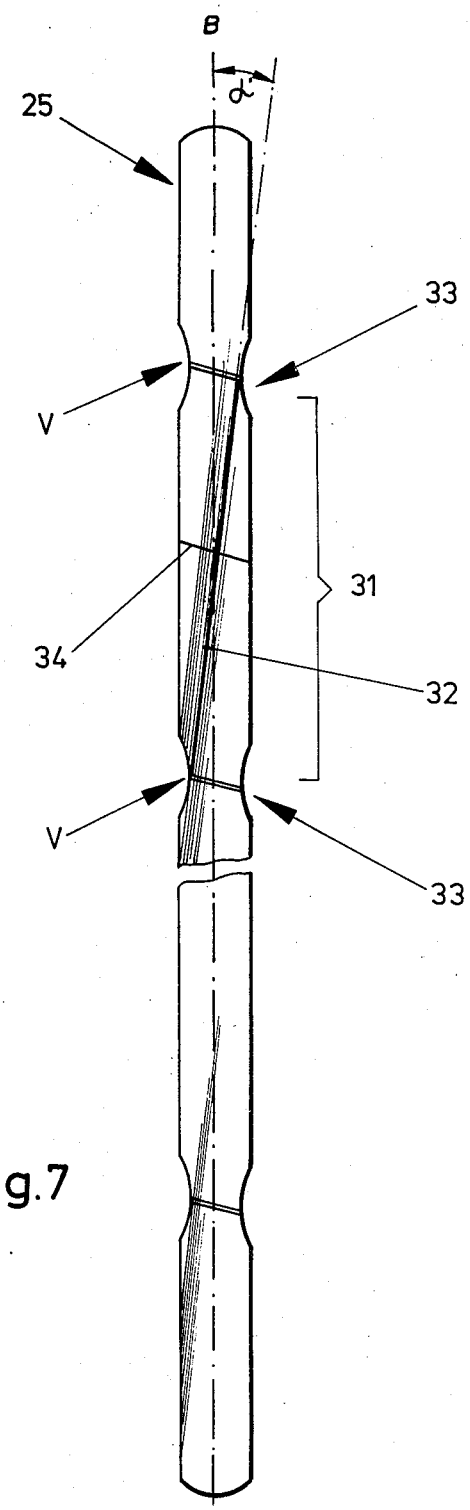
FIG. 7 shows a top plan view of a grinding belt.

Adjacent each connection position V, the grinding belt is provided at both sides thereof with segment-shaped cutouts 33 for avoiding the disadvantages caused otherwise by the increased thickness of the belt at the interconnected portions. As shown in FIG. 7, the longitudinal ends of the belt sections at the interconnected portions thereof extend parallel to the direction of the weft threads 34, i.e., perpendicular to the warp threads.

Due to the above described configuration, the grinding belt is able to smoothly conform to the pressure roller without distortion, so that with the employment of a pressure roller having a crowned surface it is possible to obtain point-contact of the grinding belt with the workpiece.

As already pointed out, apparatus 1 is constructed as a copy-grinding machine. This implies the presence of a scanning roller 35 cooperating with the master model 11, as diagrammatically shown in FIG. 6. The scanning roller is supported in a not shown mounting the construction of which is identical with that of the mounting for the belt grinding unit 15, i.e. the scanning roller 35 is mounted in the same manner as the pressure roller 23 on an axis normal to the axis of rotation L. Unlike the pressure roller, however, the scanning roller is freely rotatable, i.e., not driven.

Figure 6:
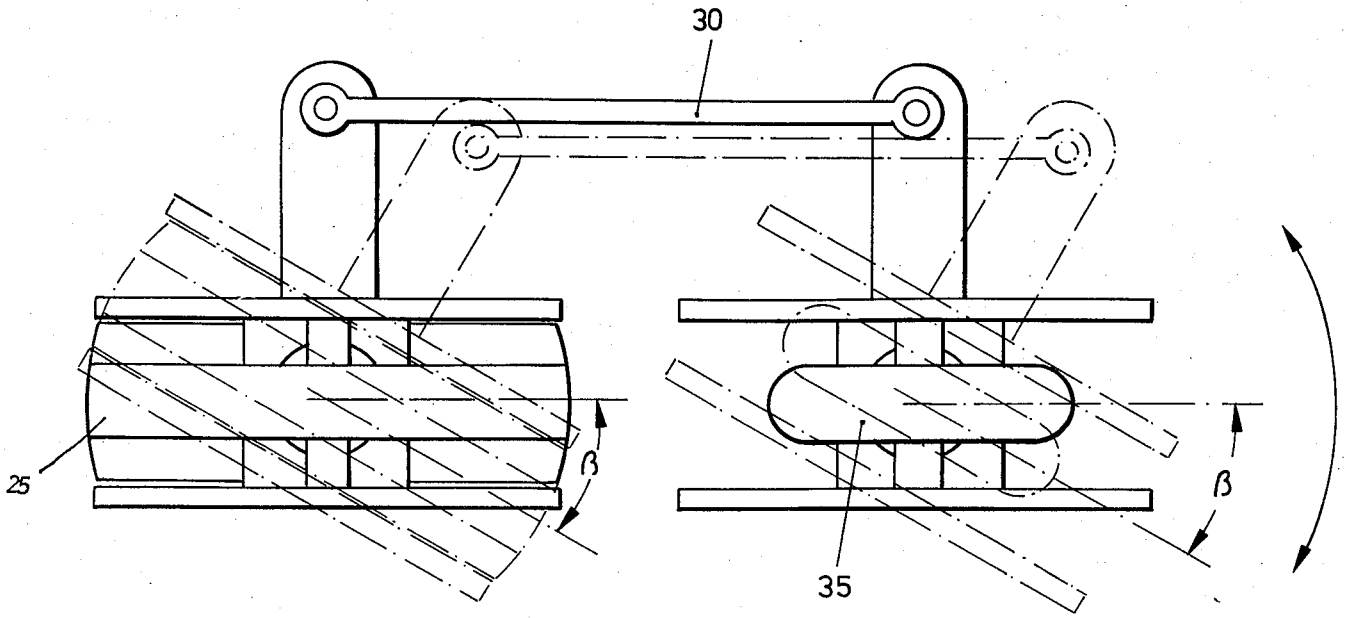
FIG. 6 shows a diagrammatic representation of the operative connection between a contact grinding roller and a scanning roller.

The operative coupling required for copy-grinding is obtained on the one hand via a frame 36 (FIGS. 2 and 3) provided at the end of the upper parallel arm 16, interconnecting the two parallel arm systems for synchronous movement, and on the other hand, via the already mentioned coupling rod 30 operatively connecting the respective pivot axes for coordinating their angular positions. This arrangement thus serves to synchronize not only the advancing movement as shown in FIG. 3, but also the adjustment of the angular position as shown in FIG. 6.

The scanning roller mounting system is connected to the grinding tool mounting system through the already mentioned transverse bracket 17. As shown in FIG. 1, bracket 17 is affixed at both of its ends to guide carriages 37 supported on guides 38 for displacement in the direction of the axis of rotation L. The advancing movement of the guide carriages is controlled by the already mentioned second output shaft of drive means 14 via respective threaded shafts 39. Each guide carriage is operatively connected to its threaded shaft through a travelling nut 40.

The apparatus according to the invention operates as follows: Initially, the grinding tool 15 is located together with the scanning roller at a starting position, for instance adjacent the right-hand end of the workpiece 2. Motor 28 is then started to drive the grinding belt, and the clamping device with workpiece 2 is rotated via the transmission in housing 14. Threaded shafts 39 are also rotated. Operation of biassing cylinder 18 causes scanning roller 35 to scan master model 11 and synchronous movement of pressure roller 23, i.e., the grinding tool is advanced from its starting position A to its operative position B as shown in FIG. 3.

Since the workpiece to be shaped has contoured surface areas extending generally transversely of the axis of rotation L, such as ridge 5, the grinding tool is rotated from its position shown in FIG. 3, in which it is disposed accurately at right angles to the axis of rotation L, to its position shown in FIG. 2, in which it is disposed slightly obliquely, and is then locked in this position. This oblique position is also shown in FIG. 10. Due to the operative coupling between the grinding tool 15 and the scanning roller, the latter is rotated in the same direction and about the same angle as the former. If the workpiece 2 is now rotated in the direction shown in FIGS. 2 and 3, grinding of the wave-shaped contours does not offer any difficulties, since the crowned pressure roller 23 provides for point-contact between the workpiece and the grinding belt, the inclined position of the latter preventing its lateral edges from cutting into the contoured surface portions.

The angle and direction of inclination has to be empirically determined for each workpiece. In the present case, the operation of the grinding tool might be described as slightly oblique transverse grinding. The advance of the guide carriages 37 together with the rotation of the master model and the workpiece results in the entire surface of the master model being consecutively scanned, and the entire surface of the workpiece being ground.

At the end of the operation, the grinding tool may be returned together with the scanning roller to the starting position A preparatory for a subsequent cycle of operation.

The pivotal mounting of the grinding tool in the apparatus according to the invention permits not only transverse grinding with respect to the longitudinal axis of the clamping device, but also longitudinal grinding, with the grinding tool rotating in the plane of the longitudinal axis of the clamping device. Depending on the shape of the workpiece it may sometimes be advantageous to employ the already mentioned intermediate positions between longitudinal and transverse grinding.

For enabling the grinding tool to be adjusted to its optimum position with respect to certain surface areas of more complicated workpieces, or with respect to the entire surface thereof, the variations of the angle of attack of the tool's axis of rotation may be controlled by the employ of stencils or master models. Possibly the inclination of the tool's pivot axis 20 relative to the axis of rotation L of the clamping device may also be made variable such as by one of the arms 16 being adjustable in length.

What is claimed is:

1. An improvement in apparatus for copy-grinding workpieces consisting particularly of wood or a similarly grindable material, e.g., aluminum, and having uneven surfaces, said apparatus comprising a rotatable clamping device for receiving a workpiece therein, at least one driven grinding tool positively controlled by a scanning roller scanning a master model and advanceable along the workpiece in the direction of the axis of rotation of the clamping device by an advance mechanism, and means for rotating the master model about an axis of rotation, wherein the workpiece has wave-shaped, concave surface areas extending generally transversely to the axis of rotation of said clamping device, the improvement comprising means for mounting the grinding tool for pivotal movement about an axis generally normal to the axis of rotation of the clamping device, means for mounting said scanning roller for pivotal movement about an axis generally normal to the axis of rotation of the master model and means coupling said grinding tool to said scanning roller for transmitting a selected angle of attack of said grinding tool.

2. Apparatus according to claim 1, characterized in that said grinding tool is mounted on pivotable parallel arms.

3. Apparatus according to claim 2, characterized in that said grinding tool is rotatably mounted in a guide bushing at each of said arms.

4. Apparatus according to claim 1, characterized in that said grinding tool has a crowned working surface.

5. Apparatus according to claim 4 comprising a belt grinding unit as the grinding tool, wherein the belt grinding unit includes a grinding belt and a pressure roller, characterized in that at least the pressure roller is of toroidal shape.

6. Apparatus according to claim 5, characterized in that the grinding belt is composed of a plurality of woven belt sections having warp threads and weft threads, said sections being interconnected at their longitudinal ends, with their warp threads extending at a slightly inclined angle with respect to the longitudinal axis of the belt.

7. Apparatus according to claim 6 characterized that each belt section comprises at least one warp thread continuously extending from one point of connection of said belt sections to the next adjoining points of connection.

8. Apparatus according to either claim 6 or 7, characterized in that the grinding belt has segment-shaped cutouts on both sides of each point of connection of said woven belt sections.

9. Apparatus according to either of claim 6 and 7, characterized in that the longitudinal ends of the belt sections extend parallel to the direction of the weft threads.

10. Apparatus according to any of claims 5, 6 or 7 characterized in that the pressure roller has associated therewith a rearwardly offset belt guide at each side thereof for guiding the grinding belt in a roof-shaped configuration over the pressure roller.

11. Apparatus according to claim 9, characterized in that the longitudinal ends of the belt sections extend parallel to the direction of the weft threads.

* * * * *